United States Patent [19]

Okada

[11] Patent Number: 5,010,995

[45] Date of Patent: Apr. 30, 1991

[54] SLOT MACHINE

[75] Inventor: Kazuo Okada, Tokyo, Japan

[73] Assignee: Kabushiki Kaisha Universal, Tochigi, Japan

[21] Appl. No.: 97,423

[22] Filed: Sep. 15, 1987

Related U.S. Application Data

[63] Continuation of Ser. No. 732,248, May 1, 1985, abandoned.

[30] Foreign Application Priority Data

May 7, 1984 [JP] Japan ..... 59-65537

[51] Int. Cl.[5] ..... G07F 17/34

[52] U.S. Cl. ..... 194/219; 273/138 A

[58] Field of Search ..... 194/219; 273/138 A, 273/143 R

[56] References Cited

U.S. PATENT DOCUMENTS 4,023,704 5/1977 Pitel et al. ..... 221/75

FOREIGN PATENT DOCUMENTS 1348309 3/1974 United Kingdom ..... 273/143 R
1582942 1/1981 United Kingdom .
2078419 1/1982 United Kingdom .
2106682 4/1983 United Kingdom ..... 273/138 A

*Primary Examiner*—F. J. Bartuska
*Attorney, Agent, or Firm*—Young & Thompson

[57] ABSTRACT

A slot machine of the type having a plurality of rotatable reels, each bearing an annular row of various symbols on the outer surface thereof, which selects combinations of symbols at random during each game, and which awards prize coins when predetermined prize-winning combinations of symbols occur on prize-winning rows previously selected. For selectively designating prize-winning rows, the slot machine is provided with push buttons which also start the rotation of the reels.

4 Claims, 2 Drawing Sheets

5
6
7
37
38
39
28
29
30
5a
6a
7a
25
26
27
HOPPER
45
C
R
COUNTER
34
35
36
PAY OUT CONTROLLER
44
SYMBOL DISCRIMINATION
40
41
42
JUDGEMENT
32
21
23
22
RANDOM NUMBER GENERATOR
STOP
MOTOR CONTROL
START
25'
COUNT DOWN
20
PULSE COUNTER
12
DIGIT DISPLAY UNIT
COUNT UP
24
PULSE GENERATOR
COIN SENSOR
19
16
17
18
11

SLOT MACHINE

This application is a continuation of application Ser. No. 732,248, filed May 1, 1985 now abandoned.

BACKGROUND OF THE INVENTION

The present invention relates to slot machines of the type which selects combinations of symbols at random during each game and awards prizes when predetermined prize-winning combinations occur on designated prize-winning rows.

As is well known in this art, slot machines of this type have a plurality of rotatable reels each of which is provided with an annular row of various symbols on the outer surface thereof. During a game, each reel is caused to rotate, and is stopped at random at one of possible stop positions in each of which it displays a corresponding symbol to a player through a window. Recently, there have been proposed slot machines of this type, which use a simulated video display of a plurality of rotating reels. In either case, such slot machines are provided with a starting lever or button for starting the reels to rotate all at once, stop buttons for selectively individually stopping the respective reels preferably at mutually different moments of time after the start of the reels, and detector means for detecting the occurrence of the prize-winning combinations on the designated prize-winning rows.

In general, slot machines are prepared for playing a game only by inserting a coin or coins into a slot thereof after a previous game has ended. Because, in such slot machines, it is usual to play the same game repeatedly, it is a nuisance for the player to have to insert coins into the slot for every game. In order to avoid this, there have been developed slot machines of the type which allows inserting a number of coins at one time before playing games and which counts down the number of coins used every game. Such slot machines are convenient to operate, because a game can be repeated many times without inserting coins before every game.

In order to increase the player's interest in the game, there have been provided slot machines of the type which allows players to select prize-winning rows. Slot machines of this type have, for example, three reels each of which, during a game, is stopped at random at one of the possible stop positions in each of which it displays a corresponding set of three symbols arranged in a vertical row in a window. Therefore, the slot machine selects three combinations of symbols arranged in three horizontal or transverse or even diagonal rows in the window and awards prize coins when predetermined prize-winning combinations occur on any of the selected rows as a prize-winning row. In slot machines of this type, the number of prize-winning rows is selected corresponding to the number of coins inserted into the slot machine. For example, the slot machine assigns the center row as the prize-winning row for one coin, the upper two rows for two coins and all three horizontal rows for three coins. After the completion of the step of assigning prize-winning rows, the operation of the starting lever or button is made possible, permitting the player thereafter to start the reels.

However, a slot machine of the type which allows inserting a number of coins at once as well as selectively assigning prize-winning rows, does not permit assigning prize-winning rows corresponding to the number of coins inserted immediately before each game. Such slot machines, therefore, require the provision of means which is operated selectively to assign prize-winning rows before the operation of starting lever or button for starting the rotation of reels.

The provision of assigning means, which obliges a player to operate a starting lever or button for starting the rotation of the reels every time the assignment of prize-winning rows is made, encumbers the game, because the starting lever or button has to be operated a number of times corresponding to the number of games repeatedly tried.

OBJECTS OF THE INVENTION

It is therefore a primary object of the present invention to provide a slot machine of the type having means for selectively assigning prize-winning rows, in which the operation of starting the rotation of reels is simplified.

It is another object of the present invention to Provide a slot machine of the type having means for selectively assigning prize-winning rows, in which a starting mechanism for the rotation of reels comprises a reduced number of parts and the facilitated operatiOn Of playing a game is realized.

SUMMARY OF THE INVENTION

To accomplish the above objects, the present invention provides that the rotation of the reels is caused as a result of the operation of means for selectively assigning prize-winning rows.

According to the present invention there is provided a slot machine in which the reels are simultaneously started to rotate by the operation of one of a plurality of manually operable means for selectively assigning prize-winning rows.

BRIEF DESCRIPTION OF THE DRAWINGS

These and other features and advantages of the invention will be described in more detail in the following, by way of an example, reference being made to the accompanying drawings, in which.

DETAILED DESCRIPTION OF THE INVENTION

Figure 1:
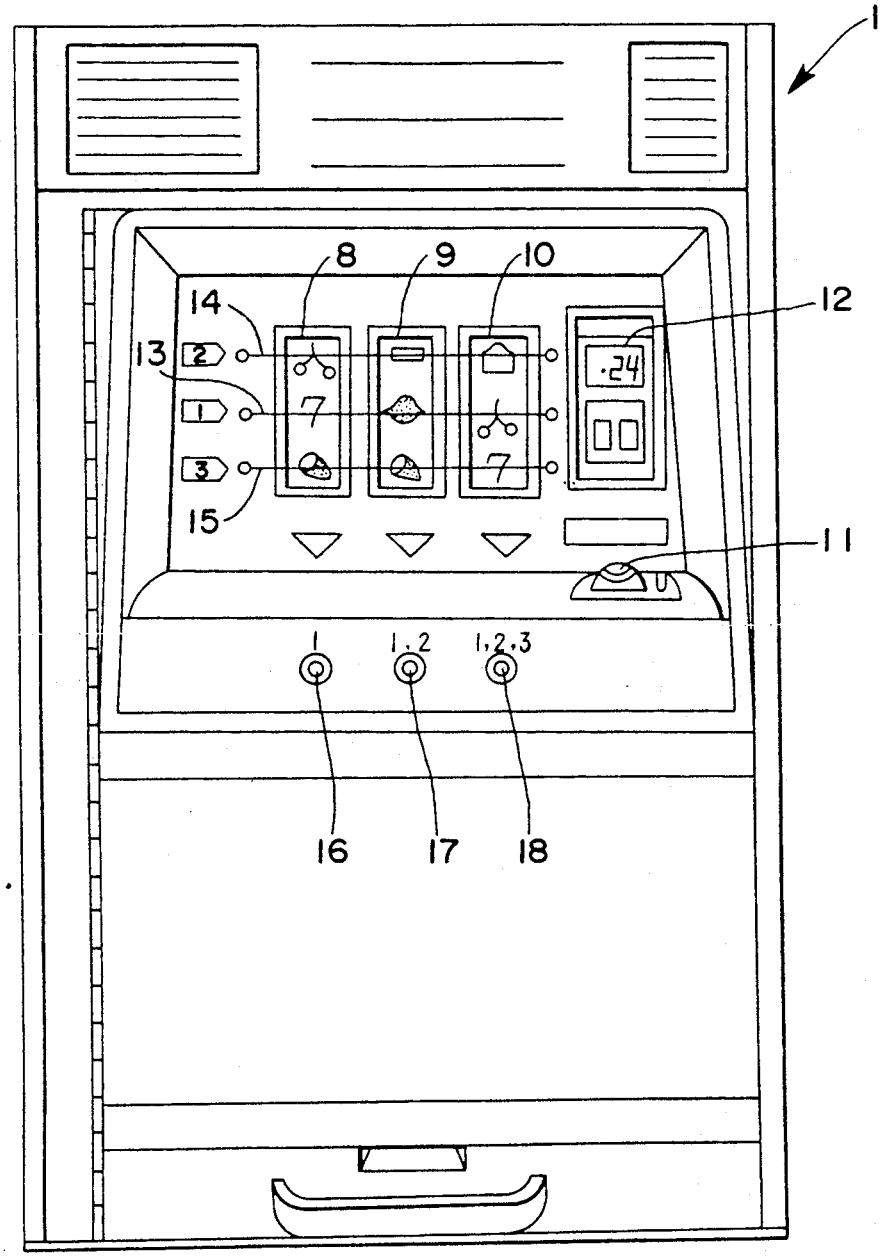
FIG. 1 is a front view showing an embodiment of the slot machine according to the present invention.

Referring now to FIG. 1, shown therein is a slot machine 1 which comprises a set of rotary reels 5, 6 and 7 mounted side by side on a common shaft so as to be individually rotatable. Each one of the reels, 5, 6 and 7 is provided with an annular row of various symbols on the outer surface thereof and, during a game, is stopped at random at one of the possible stop positions in each of which it displays corresponding symbols to a player in one of windows 8, 9 and 10 formed in the front panel. As seen in FIG. 1, each rectangular window has a height sufficient to display three symbols in a vertical row therein.

The slot machine 1 is adapted to allow inserting a number of coins, medals or tokens (which are hereafter referred to as coins) thereinto through a slot 11 prior to playing games. The number of the coins inserted is indicated on a digital display unit 12, each elemental digit comprising seven segments of light emitting diodes. Three transverse rows of combinations of symbols on the reels 5, 6 and 7 which are visible through the windows 8, 9 and 10 win prizes when any combination of symbols occurs corresponding to any of a plurality of predetermined prize-winning combinations. In practice, a player can select the prize-winning row or rows. For this selection, the slot machine 1 is provided on its operation, panel with push buttons 16, 17 and 18 for assigning the middle transverse row 13, the upper and middle transverse rows 13 and 14 and all three horizontal transverse rows 13 to 15 as the prize-winning row or rows, respectively.

The number of coins spent per game corresponds to the number of transverse rows designated as prize-winning rows, for example, three coins for three transverse rows, two coins for two transverse rows and one coin for a single transverse row. Consequently, in response to the pushing of one of the buttons 16 to 18, the number of coins is reduced by the number of coins to be spent and the number of remaining coins is indicated on the digital display unit 12.

When pushing one of the buttons 16 to 18 for designating prize-winning rows, the reels 5 to 7 are started to rotate simultaneously with the reduction of the remaining number of coins. After a certain time has elapsed, the reels 5 to 7 are stopped at random based on random programmed numbers, each at one of the possible stop positions, and so display corresponding symbols to the player through the associated windows.

Figure 2:
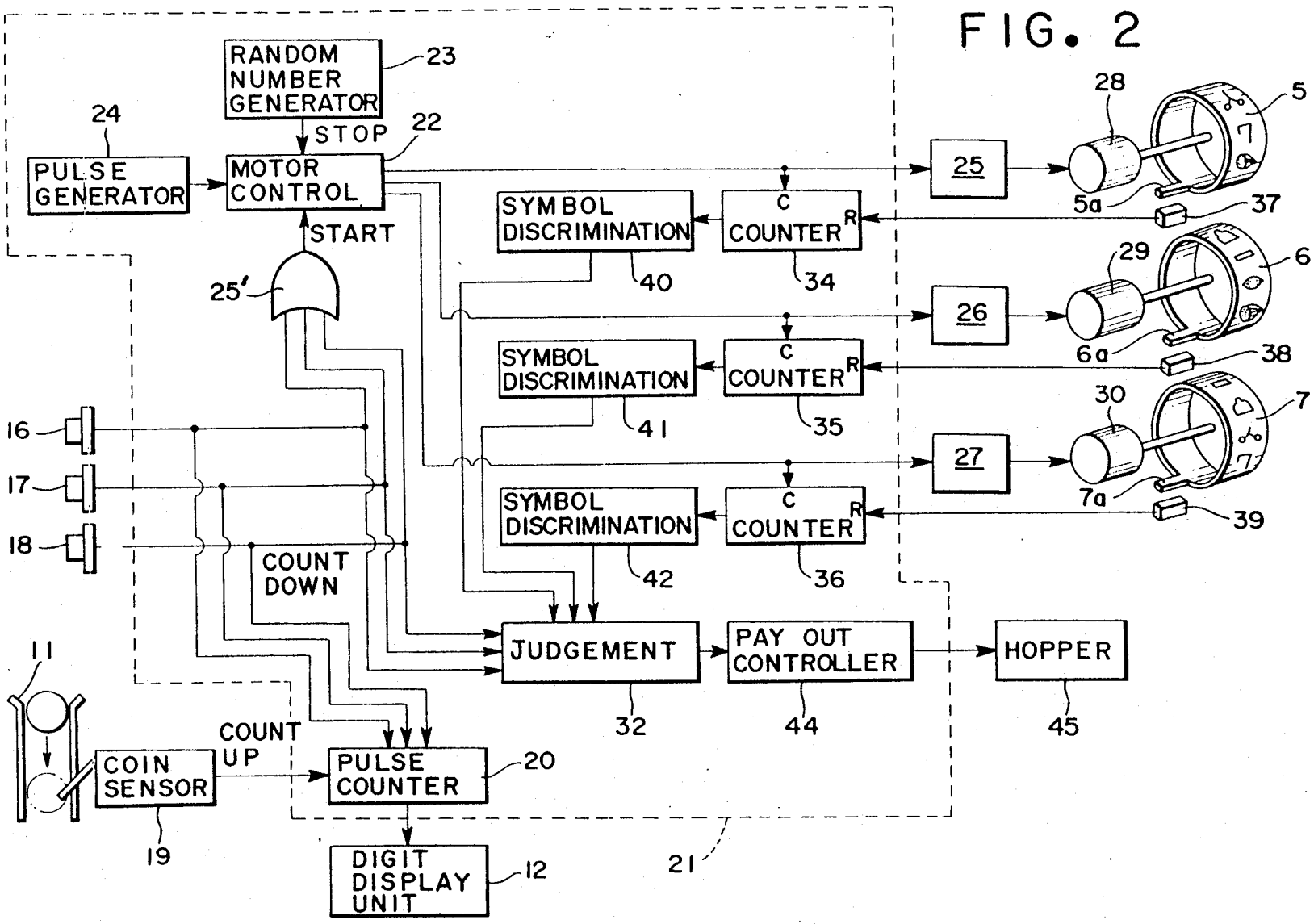
FIG. 2 is a block diagram showing a game circuit applied to the slot machine of FIG. 1.

Referring now to FIG. 2, there is shown therein, in a block diagram, a control circuit for the slot machine described above with reference to FIG. 1. In FIG. 2, the section 21 enclosed with the dotted line is a microcomputer.

Upon inserting a number of coins into slot 11 prior to playing games, sensing means 19 senses the coins inserted so as to provide pulse signals, corresponding to the number of the coins, which are transmitted to and counted by a pulse counter 20. The counted value by the counter 20 is indicated on the digital display unit 12. To designate prize-winning rows, the button 17, for example, is pushed to provide pulse signals which in turn are directed toward the counter 20. The counter 20 counts down two counts and causes the digital display unit 12 to indicate the number of remaining coins. Simultaneously with the operation of the push button 17 for actuating the counter 20, the motor control 22 is actuated by receiving a signal gated by the OR gate 25' to derive a clock pulse signal from a clock pulse generating circuit 24 and deliver it to motor driving circuits 25 to 27 so as to cause pulse motors 28 to 30 to rotate. Counters 34 to 36 commence counting up at the clock pulse rate from the clock pulse generating circuit 24. The pulse motors 28 to 30 thus caused to rotate cause the respective reels 5 to 7 to rotate and to occupy positions corresponding to counts of the respective counters 34 to 36.

The reels 5 to 7 are provided on their periphery with projections 5*a* to 7*a* which cooperate with photosensors 37 to 39, respectively, so as to provide, every time the projections pass the photosensors, signals each of which in turn is directed to the respective counter 34 to 36 to reset its content to an initial value, for example zero.

It should be noted that the numbers of pulses counted by each counter have one-to-one correspondence to the respective symbols arranged on the peripheral surface of each reel associated with the counter. Thus, it can be detected based on the content of the counter, which symbols are displayed in the window.

When a certain time has elapsed after starting the rotation of the reels, a random number generator 23 is actuated to provide signals which in turn are directed to the motor control 22 and shut it off to stop the rotation of the respective pulse motors 28 to 30. At this time, symbol discriminating circuits 40 to 41 derive the contents of the respective counters 34 to 36 as signals to determine which symbols are displayed in the respective windows 8 to 10. A set of the signals which represent a combination of symbols is transmitted to a judging means 32 wherein various prize-winning combinations of symbols are memorized as combinations of signals and compared therein with each of the combinations of signals. The decision that there has occurred a prize-winning combination of symbols is made, based on the correspondence between these signals. When the upper and middle transverse rows 13 and 14 are designated as prize-winning rows by pushing the button 17, a signal is delivered to the judging unit 32 and causes it to compare two sets of signals with each prize-winning combination of signals memorized therein. The second set of signals is made based on the first set of signals which consist of the signals from the symbol discriminating circuits 40 to 42 because the counted numbers of pulses have one-to-one correspondence to the respective symbols arranged on the peripheral surface of each related reel.

When a predetermined prize-winning combination occurs on a prize-winning line, a prize signal is applied to a controller 44 which causes a coin hopper 45 to pay out coins of a corresponding number.

Instead of applying the prize signal to the coin payout controller for paying out coins every game, pulses of the numbers corresponding to the prize signal may be directed to the counter 20 for counting up. In this case, coins corresponding to the counted number of pulses are paid out by operating a pay out button (not shown) when the player is through.

Although the invention has been described in detail with particular reference to a preferred embodiment thereof, the invention is not limited to that embodiment, but various variations and modifications thereof may be made without departing from the scope of the invention. For example, it is possible to designate diagonal rows as prize-winning rows and to provide stop buttons for the respective reels. The push buttons 16 to 18 may also be used for stopping the reels. The present invention is, of course, applicable to slot machines of the type which allows using a particular card instead of coins.

What is claimed is:

1. In a slot machine including a plurality of adjacent lengthwise movable series of different symbols, means for selecting combinations of symbols at random during a game, and means for awarding prize coins when predetermined combinations of symbols result on prize-winning rows of symbols, the improvement which comprises (a) means for sensing the insertion of at least one coin in the machine; said sensing means producing a signal for each coin inserted;

(b) counter means for counting the signals from said sensing means;

(c) display means providing a visual indication of a positive content of said counter means;

(d) means for initiating the lengthwise movement of said plurality of series to produce random combinations of symbols in a plurality of horizontal rows; and (e) a plurality of player-actuated pushbuttons which are operable when a positive content of said counter is indicated on said display means, the operation of one of which simultaneously (1) designates at least one of said horizontal rows of symbols as a prize-winning row;

(2) actuates said movement initiating means to initiate movement of said series; and (3) decreases the content of said counter means in accordance with the number of horizontal rows designated, at least two of said pushbuttons each designating a different combination of plural prize-winning rows prior to each game.

2. Apparatus as defined in claim 1, wherein said pushbuttons selectively assign center, upper and lower transverse horizontal rows as prize-winning rows.

3. Apparatus as defined in claim 2, where said plurality of pushbuttons comprise three pushbuttons for selecting center, center and upper, and center, upper and lower transverse rows, respectively, as prize-winning rows.

4. A slot machine of the type having a plurality of lengthwise movable series of different symbols, means to select combinations of symbols at random during each game, and means to award prize coins when predetermined prize-winning combinations occur on prize-winning rows of symbols, comprising (a) player-actuated means for designating any selected one of a plurality of combinations of plural prize-winning rows prior to each game, wherein said each combination has different number of said prize-winning rows in such a way that a combination with larger number of the prize-winning rows has all rows which another combination with smaller number of the prize-winning rows has; and (b) means for starting the lengthwise movement of said series, said means for starting the lengthwise movement of said series operating to start the lengthwise movement of said series responsive to actuation by the player of said designating means.

* * * * *